United States Patent [19]

Durkan, Jr.

[11] Patent Number: 4,712,701

[45] Date of Patent: Dec. 15, 1987

[54] SUPER-ELLIPTICAL ADAPTOR RING FOR REFUSE CONTAINERS AND THE LIKE

[76] Inventor: Martin J. Durkan, Jr., 3000 Lind Ave. SW., Renton, Wash. 98055

[21] Appl. No.: 906,968

[22] Filed: Sep. 15, 1986

[51] Int. Cl.[4] ..... B65D 6/34

[52] U.S. Cl. ..... 220/71; 220/1 T

[58] Field of Search ..... 220/71, 72, 1 T; 232/43.1

[56] References Cited

U.S. PATENT DOCUMENTS

| | | | |
|---|---|---|---|
| 3,804,290 | 4/1974 | Billman | 220/72 |
| 3,880,315 | 4/1975 | Nelson et al. | 220/72 |
| 3,927,786 | 12/1975 | Aboud | 220/1 T |
| 4,335,828 | 6/1982 | Robinson et al. | 220/1 T |
| 4,450,976 | 5/1984 | Snyder et al. | 220/343 |
| 4,550,849 | 11/1985 | Adsit | 220/1 T |
| 4,650,089 | 3/1987 | Sanders | 220/1 T |
| 4,666,035 | 5/1987 | Johnson | 220/72 |

OTHER PUBLICATIONS

Durable Technology Inc. brochure entitled "Introducing the New and Proven Way of Automated Refuse Collection".

Durable Technology Inc. brochure entitled "Introducing the New and Proven Way of Residential Trash Collection".

Durable Technology Inc. brochure entitled "'DURA-KAN' means 'DURABILITY'".

Chironis, "Between the Circle and Square Lie the Handy Supercurves", Product Engineering, Apr. 24, 1967, pp. 52–55.

*Primary Examiner*—Joseph Man-Fu Moy

*Attorney, Agent, or Firm*—Graybeal, Jensen & Puntigam

[57] ABSTRACT

A super-elliptical adaptor ring for adapting a substantially rectangular refuse container to be readily handled by a robotic manipulator of substantially rounded objects. The outer surface of the adaptor ring has a super-elliptical horizontal cross-section. The super-ellipse defining the outer surface has an exponent between about 4.0 and about 1.5, and preferably between about 3.5 and 1.7. Optimally the super-ellipse has an exponent of about 3.0 and a ratio of length to width of about 35:32. The inner mating surfaces of the adaptor ring define a substantially rectangular horizontal cross-section conforming to the exterior shape of the container. The adaptor is removably mounted on the container by sliding the adaptor upwardly around the container until the adaptor is frictionally arrested by the exterior walls of the container. The adaptor is retained on the container by the lift bar of the container in proximal contact with the bottom of the adaptor, and by two locking arms extending upwardly above the adaptor and engaging the handle near the upper edge of the container's rear wall. A wedge-shaped element extends above the adaptor ring into a pocket formed behind a lip at the upper edge of the container's front wall.

15 Claims, 6 Drawing Figures

SUPER-ELLIPTICAL ADAPTOR RING FOR REFUSE CONTAINERS AND THE LIKE

BACKGROUND OF THE INVENTION

1. Technical Field

This invention relates to refuse containers. More particularly, this invention relates to a device for adapting substantially rectangular refuse containers and the like to be manipulated by a robotic-type manipulator for substantially rotund objects.

2. Description of the Prior Art

Refuse collection is becoming increasingly mechanized. As little as ten years ago, laborers hoisted to their shoulders heavy steel cans filled with garbage and carried the containers to, and emptied the contents into, a truck parked at the curbside. This essentially manual system for transferring refuse from the customers' containers to the collection truck has rapidly become uneconomical in nations having rising wage rates and falling costs of automation.

Automated refuse collection systems are improving the efficiency of refuse collection and reducing the need for highly paid manual refuse collectors. In both semi-automated and fully automated refuse collection systems the entire customer base is provided with identical refuse containers, and the collection trucks are equipped with lifting mechanisms for automatically emptying such containers.

In a semi-automated refuse collection system, the filled refuse containers must be manually positioned on the lifting mechanism on the truck. The containers are substantially rectangular and have a lifting receptacle located in one of the flat vertical walls of the container. The mechanism engages and locks into the lifting receptacle of a container, then lifts the container until it is inverted over the truck, emptying the contents into the truck. The container is then lowered and manually disengaged from the lifting mechanism, and manually returned to its original place.

Fully automated refuse collection systems eliminate the need for manual movement of the container to and from the truck. The trucks of fully automated systems are equipped with lifting mechanisms which comprise a robotic-type manipulator disposed at the end of an articulated mechanical arm. Customers are required to place their containers at or near the curbside, where they can be reached by the manipulator. The truck is stopped near each container in turn. The driver operates the arm and manipulator to securely engage the container, then to lift and empty the container into the truck, and finally to replace the container in its former position. Fully automated collection systems require only one worker per truck, in contrast to the driver plus multiple laborers required by both manual and semi-automated systems.

Fully automated systems require that the customers' containers be readily handled by the robotic manipulators of the collection trucks. Such manipulators are typically designed to handle a single shape of container, usually cylindrical, frusto-conical or otherwise substantially rotund. While other shapes of containers can sometimes be handled by a manipulator for substantially rotund containers, such containers are often damaged by the imperfect junction between the manipulator and the container. There is also a significant risk that the container will slip from the grasp of the manipulator, strewing the contents along the curbside.

The rectangular containers of semi-automated refuse collection systems cannot be used in fully automated systems which require substantially rotund containers. Thus, many communities which converted to semi-automated systems cannot reap the benefits of a fully automated collection system without replacement of their existing rectangular containers with new rotund containers. The cost of such replacement is prohibitive for those less wealthy communities most in need of the savings offered by fully automated collection systems.

SUMMARY OF THE INVENTION

It is thus an object of the present invention to adapt a container of rectangular cross-section to be readily handled by a robotic-type manipulator of substantially rotund objects.

It is a further object of this invention to provide an adaptor device which is particularly suited to use with the substantially rectangular containers of semi-automated refuse collection systems.

It is another object of this invention to provide such an adaptor device which is securely yet removably attachable to the containers.

It is yet another object of this invention to provide such an adaptor device which can be economically produced in one piece from high strength plastic materials using conventional rotary molding techniques.

These and other objects are provided by a ring-like adaptor for adapting a substantially rectangular container to be handled by a robotic manipulator of substantially cylindrical objects. The container has substantially planar exterior vertical walls which taper inwardly toward a lower portion of the container. The adaptor comprises a smoothly curving outer surface having a horizontal cross-section substantially in the form of a super-ellipse, and substantially planar inner mating surfaces for frictionally engaging and mating with the exterior walls of an upper portion of the container. The inner mating surfaces of the adaptor define a substantially rectangular horizontal cross-section such that the adaptor is removably mountable on the container by sliding the adaptor upwardly from the lower portion of the container until the inner mating surfaces of the adaptor are frictionally arrested by the exterior walls of the container. The adaptor further comprises locking means for positively securing the adaptor in position around the upper portion of the container to prevent downward movement of the adaptor toward the lower portion of the container both when the container is upright and when the container is inverted. The outer surface of the adaptor is defined by a super-elliptical closed curve having an exponent less than about 4.0 and greater than about 1.5. Preferably the super-ellipse defining the outer surface of the adaptor has an exponent less than about 3.5 and greater than about 1.7, and a ratio of length to width of about 35:32.

Other features and advantages of the present invention will become apparent from the following detailed description of a typical embodiment thereof, taken in conjunction with the accompanying drawings.

DESCRIPTION OF THE PREFERRED EMBODIMENT

Figure 1:
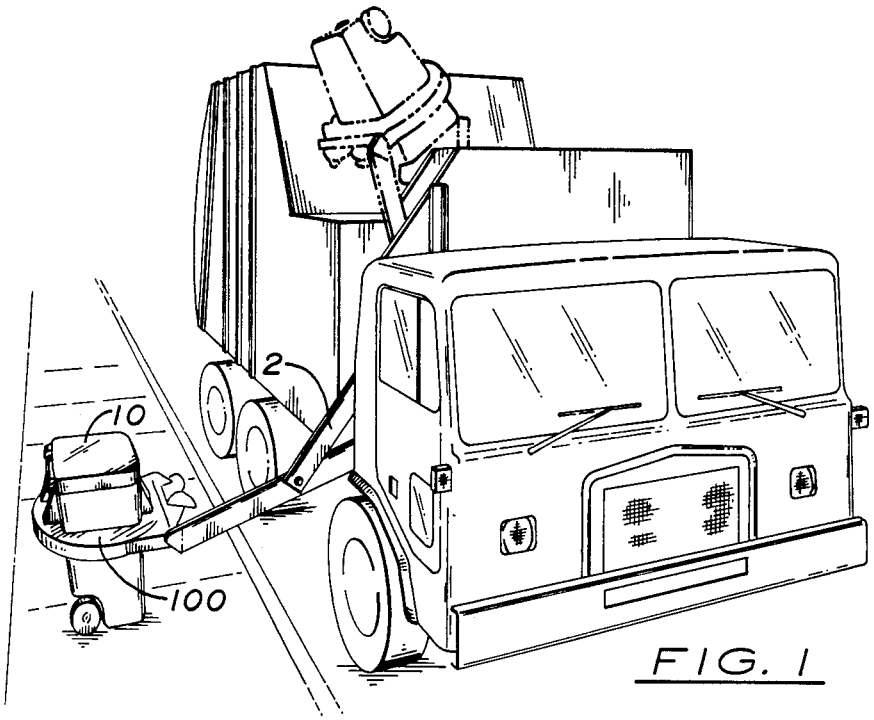
FIG. 1 is an isomeric view of the operation of a fully automated refuse collection system, showing a substantially rectangular refuse container being handled and emptied by a robotic manipulator engaging an adaptor ring according to the present invention

As shown in FIG. 1, the adaptor ring 100 of the present invention is mountable on a substantially rectangular refuse container 10. The adaptor ring 100 adapts the container 10 to be readily handled by a robotic manipulator 2 for substantially rotund containers such as is typically used in a fully automated refuse collection system. While the adaptor ring of the present invention can itself be adapted to be used with any rectangular refuse container for a semi-automated refuse collection system, the adaptor ring must of necessity be described with reference to the container upon which it shall be mounted. For purposes of description, one such substantially rectangular container for a semi-automated refuse collection system is shown in the drawings and is described herein.

A TYPICAL SEMI-AUTOMATED REFUSE CONTAINER

Figure 2:
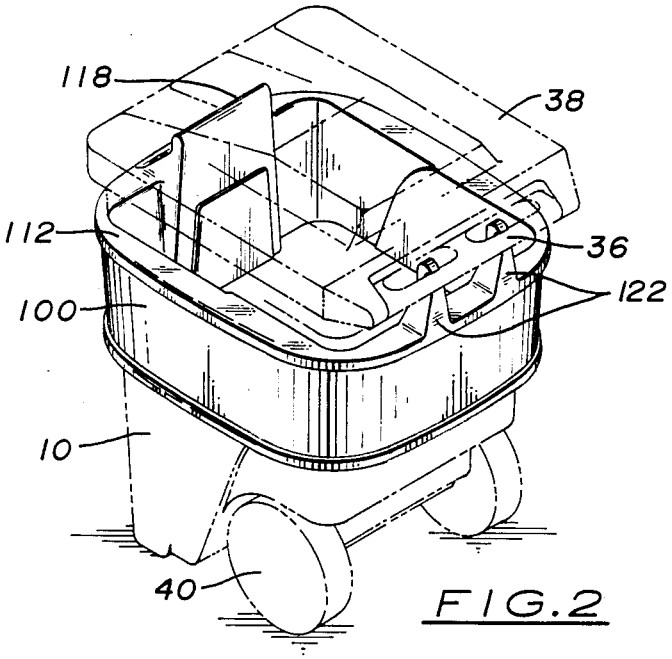
FIG. 2 is an isometric view of the adaptor ring and container of FIG. 1
Figure 3:
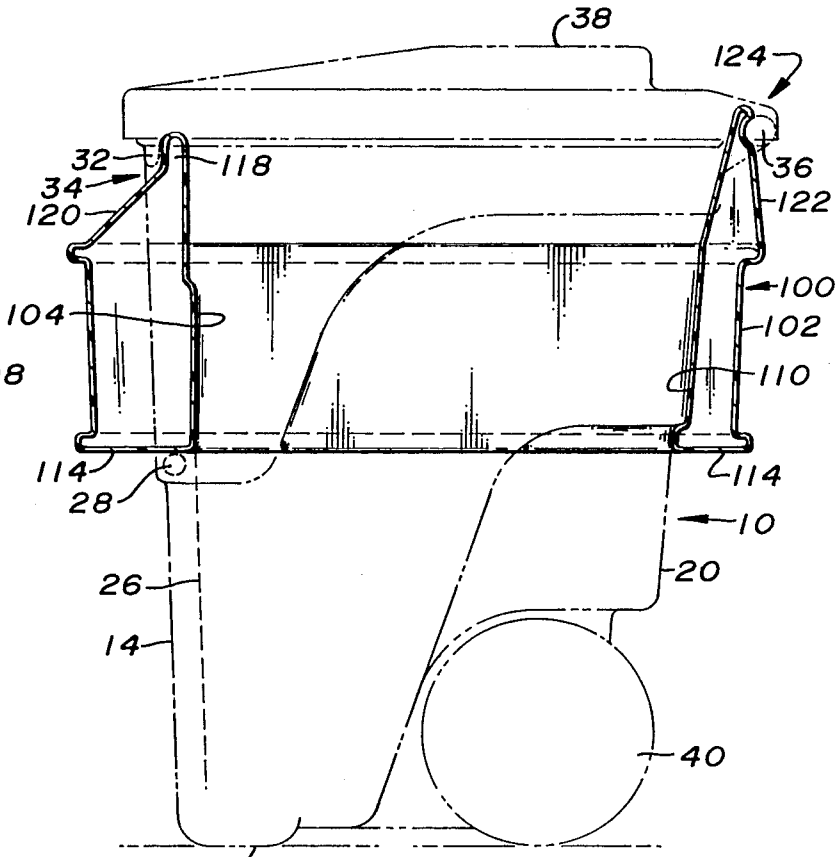
FIG. 3 is a side elevation view of the adaptor ring and container of FIG. 1, showing the front locking element and the rear locking element.
Figure 4:
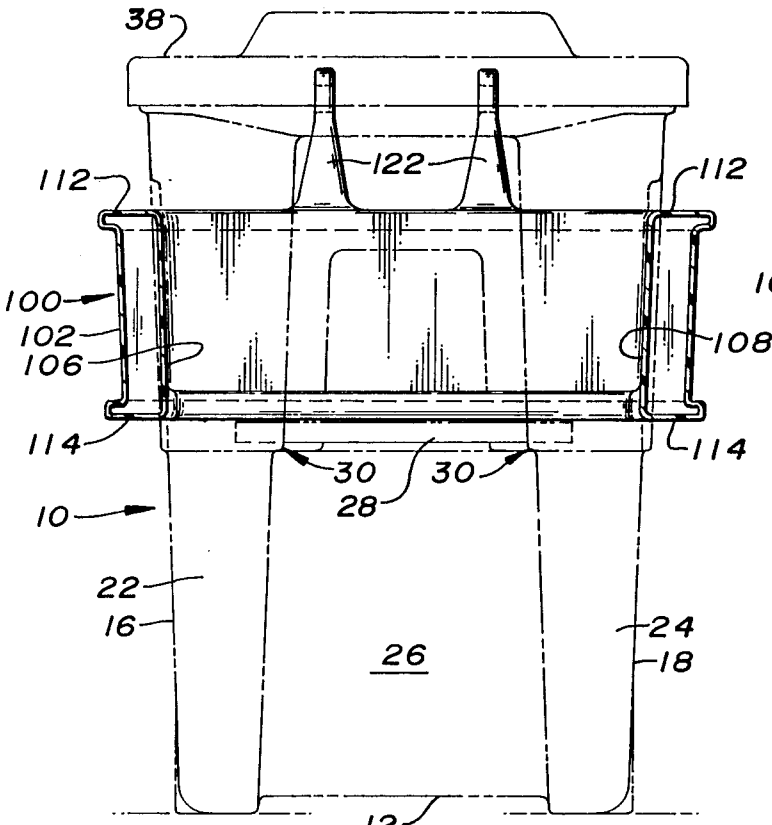
FIG. 4 is a front elevation view of the adaptor ring and container of FIG. 1, showing particularly the rear locking element.
Figure 5:
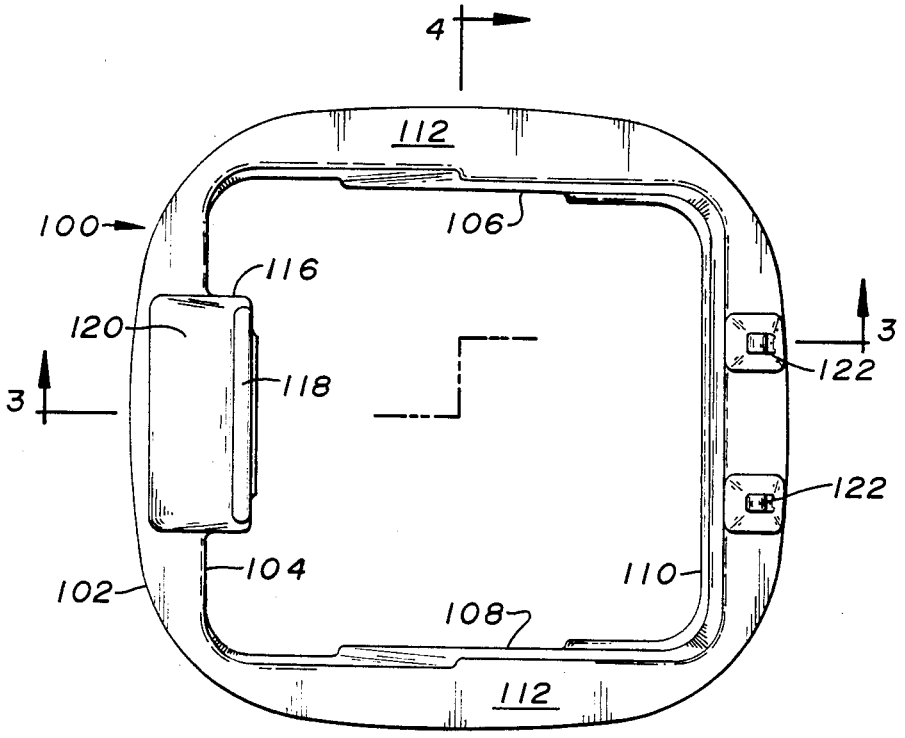
FIG. 5 is a top plan view of the adaptor ring of FIG. 1, showing the super-elliptical cross-section of the outer surface thereof.

The container 10, shown in hidden lines in FIGS. 2-4, comprises a bottom 12 and four substantially flat vertical exterior walls: a front exterior wall 14, two side exterior walls 16,18 which are mirror images of each other, and a rear exterior wall 20. The exterior walls 14, 16, 18, 20 of the container may be vertical, forming a rectangular container, or they may be sloped so as to form an inverted frusto-pyramidal container. The exterior walls 14, 16, 18, 20 form a substantially rectangular horizontal cross-section therethrough. The vertical corners formed by the junction of adjacent exterior walls of the container 10 may be slightly rounded for reasons of aesthetics or fabrication. However the radii of such vertical corners are typically much smaller than the horizontal dimensions of the exterior walls 14, 16, 18, 20 of the container 10, and thus do not affect the essential rectangularity of the container.

The front exterior wall 14 of the container 10 includes means for receiving the lifting mechanism of a semi-automated collection truck. Two side portions 22,24 of the front wall 14 are separated by a recessed center channel 26 extending upwardly from the lower edge of the front wall 14. A lift bar 28 is mounted transversely across the front channel 26 about midway between the upper and lower edges of the front wall 14. The lift bar 28 is a metal rod extending into and held in place by sockets 30 formed in the narrow side walls of the front channel 26. The lift bar 28 can be emplaced and removed by flexing outwardly the front exterior wall 14 of the container 10, forcing the side walls of the front channel 22 together with the sockets 30 formed therein to move apart from each other and thereby freeing the lift bar 28 from the sockets. A lip 32 extends downwardly from the upper edge of the front wall 14 to cover an uppermost portion of the front channel 26. The lip 32 forms a pocket 34 around an upper end of the front channel 26 behind the lip. The front channel 26, lift bar 28 and pocket 34 comprise the lifting receptacle of the container 10 for receiving the lifting mechanism of a semi-automated refuse collection truck.

The semi-automated container 10 further comprises a handle 36, a lid 38 and wheels 40. The handle 36 is mounted on the upper edge of the rear exterior wall 20 and is spaced outwardly therefrom, forming a gap between the rear wall 20 and the handle. The lid 38 covers the open upper end of the container 10, and is hinged on the handle 36 at the rear of the container. When the container 10 is lifted and inverted by the lifting mechanism of the semi-automated collection truck, the lid 38 swings open to allow the contents of the container to fall freely into the truck. The wheels 40 are journalled from the lower rear portions of the side walls 16,18 to allow the container 10 to be easily rolled about even when heavily loaded with refuse.

THE ADAPTOR RING OF THE PRESENT INVENTION

As shown in FIGS. 2–5, the adaptor 100 of the present invention is a hollow, substantially rotund, ring-like structure which is removably mountable around the rectangular container 10. The adaptor ring 100 comprises a smoothly curving outer surface 102, four inner mating surfaces 104,106,108,110, and upper and lower lateral surfaces 112,114. The inner surfaces 104,106,108,110 are joined to form a substantially rectangular cross-section which corresponds to the cross-section of, and mates with, the exterior walls 14,16,18,20 of the container 10. The inner surfaces 104,106,108,110 are positioned inwardly of the exterior surface 102 of the adaptor ring. The upper lateral surface 112 joins the upper edge of the exterior surface 102 to the upper edges of the inner surfaces 104,106, 108,110, and the lower lateral surface 114 similarly joins the lower edge of the exterior surface to the lower edges of the inner surfaces, thereby forming the hollow, substantially ring-like structure of the adaptor ring.

The inner surfaces 104,106,108,110 mate with the exterior walls 14,16,18,20 of the container 10 when the adaptor ring 100 is mounted on the container. The inner surfaces 104,106,108,110 of the adaptor ring 100 are contoured as necessary to conform to any contours in the exterior walls 14,16,18,20 of the container 10.

The exterior walls of semi-automated containers typically include a slight inward taper toward the lower portion of the container, producing an inverted frusto-pyramidal shape. The inner surfaces 104,106,108,110 of the adaptor ring 100 are similarly tapered inwardly toward the lower portion of the adaptor ring in order to produce a snug mating fit between such inner surfaces and the exterior walls 14,16,18,20 of the container 10. Because of the taper of the exterior walls 14,16, 18,20, the adaptor ring 100 is mounted on the container 10 by placing the adaptor ring around the lower portion of the container and sliding the adaptor ring upwardly until the inner surfaces 104,106,108,110 of the adaptor ring are frictionally arrested by the exterior walls 14,16,18,20 of the container, preventing the adaptor ring from further sliding upwardly along the front exterior wall 14 of the container 10.

As best seen in FIG. 3, a front indent 116 extends inwardly from the front inner surface 104 of the adaptor ring 100 into the interior of the adaptor ring to conform to the recessed center channel 26 of the container 10. The front indent 116 extends vertically from the lower lateral surface 114 of the adaptor ring 100 upwardly beyond the upper lateral surface 112 to a front rib 118 oriented horizontally and parallel to the front inner mating surface 104. The front indent 116 is of a size so that when the adaptor ring 100 is mounted on the container 10, that portion of the lower lateral surface 114 located adjacent the front indent and thus within the recessed channel 26 of the container is positioned immediately above the sockets 30 in which the lift bar 28 is retained. Thus when the lift bar 28 is emplaced in the sockets 30 beneath the lower lateral surface 114 of the adaptor ring 100, the lift bar prevents the adaptor ring from sliding downwardly along the front exterior wall 14 of the container 10.

The front rib 118 engaged within the pocket 32 of the front central channel 26 prevents the adaptor ring from sliding upwardly along the front exterior wall 14 of the container. The front rib 118 is of a size to be snugly receivable in the front pocket 34 of the container 10. To more securely support the front rib 118, an angled central brace 120 extends upwardly from the upper lateral surface 112 of the adaptor ring 100 adjacent the smoothly curving outer surface 102 to the front rib 118.

When mounted on the container 10, the adaptor ring 100 is further prevented from sliding upwardly or downwardly along the rear exterior wall 20 of the container 10 by two rear handle locking arms 122 engaging the handle 36 of the container. The handle locking arms 122 are fixedly attached to and extend vertically upward from a rear portion of the upper lateral surface 112. Distal portions of the handle locking arms 122 are snugly wedged into the gap between the handle 36 and the rear exterior wall of the container 10. Transverse notches 124 formed in the outer surfaces of the distal portions of the handle locking arms 122 securely receive the handle 36 and prevent the adaptor ring 100 from slipping downwardly along the rear exterior wall. The proximal portions of the handle locking arms 122 are thicker than the distal portions thereof, so that the locking arms wedged between the handle 36 and the rear exterior wall 20 prevent the adaptor ring 100 from further sliding upwardly along the rear exterior wall.

The smoothly curving outer surface 102 of the adaptor ring 100 is gripped by the robotic manipulator 2 to lift and empty the container into the collection truck. Upper and lower circumferential lips 126, 128 extending outwardly from the upper and lower edges respectively of the outer surface 102 for a sufficient distance to prevent the robotic manipulator 2 from slipping off the adaptor ring 100.

THE SUPER-ELLIPTICAL OUTER SURFACE OF THE ADAPTOR RING

The optimum shape of the smoothly curving outer surface 102 of the adaptor ring 100 is determined by balancing several opposing factors. The most significant of these factors are the ability of the robotic manipulator to handle containers of other than circular cross-section, the dimensions and rectangularity of the horizontal cross-section of the container to be adapted, and externally imposed constraints on the design of the containers.

Robotic manipulators for substantially rotund containers are somewhat capable of handling substantially rectangular containers. However such mismatching between manipulator and container tends to result in damage to the container or the manipulator. However the container cannot usually be adapted to meet the ideal shape for the manipulator due to the existing size and shape of the container and to the design constraints on refuse containers in general. Refuse containers must be sized to easily pass through a conventional thirty-two inch (32") (about 70 cm) gate or doorway. Thus at least one horizontal dimension of the adaptor ring must be less than this limiting value. The other horizontal dimension of the adaptor ring may be greater than this limiting value, but is significantly limited by the existing dimensions of the container, and by aesthetic considerations.

These design constraints may be best understood using a simple example based on a substantially square refuse container having completely vertical exterior walls, with the front, side and rear walls defining a container about twenty-eight inches (28") (70 cm) square. If an adaptor ring having a perfectly cylindrical outer surface were to be placed around such a container, the diameter of the outer surface would be at least thirty-nine inches (39") (100 cm). Thus an outer surface having a perfectly round horizontal cross-section would not meet the thirty-two inch (32") (80 cm) limit imposed by the width of conventional gates and doorways. In other words, a perfectly circular cross-section is too circular. However as the cross-section of the outer surface of the adaptor ring is made less circular and more rectangular it is less easily handled by the robotic manipulator. The adaptor ring 100 of the present invention strikes an optimum balance between the circularity required by the robotic manipulator and the rectangularity required by the width constraints on refuse containers and the dimensions of existing rectangular refuse containers for semi-automated collection systems.

The rectangularity or circularity of an object can be described with reference to the equation which defines the two-dimensional closed curve of the horizontal cross-section through the object. The general formula for a closed curve in the two-dimensional plane having axes 'x' and 'y' is as follows:

$$(x/l)^n+(y/w)^n=1$$

Curves conforming to this equation are known generically as "super-ellipses".

Figure 6:
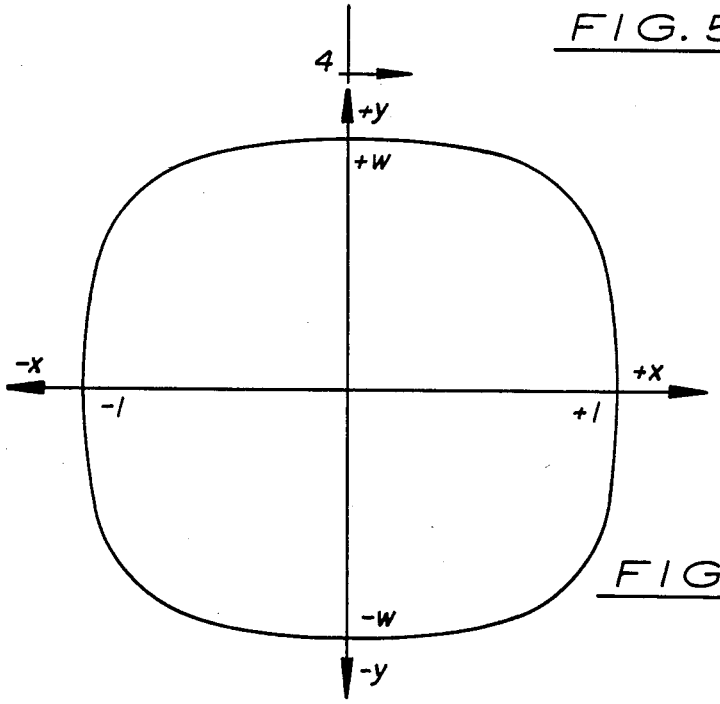
FIG. 6 shows the coordinate system used to describe the two-dimensional super-elliptical curves which define the horizontal cross-sections of the exterior walls of the container and the outer surface of the adaptor ring.

In reference to the super-elliptical curve comprising the horizontal cross-section of the adaptor ring 100 described above, and as shown in FIG. 6, the terms 'x' and 'y' define the coordinates of all points on the curve, measured from the intersection of the 'x' and 'y' axes. The 'x' axis is the longitudinal axis oriented horizontally front to back, and along which the length of the adaptor ring is measured. The 'y' axis is the lateral axis oriented horizontally and perpendicularly to the 'x' axis, and along which the width of the adaptor ring is measured. The terms 'l' and 'w' define the gross dimensions of the curve, 'l' representing the length of the curve as measured along the 'x' axis, and 'w' representing the width of the curve as measured along the 'y' axis. When the length 'l' and width 'w' are unequal, the result is an elongated, substantially elliptical or rectangular curve which is bilaterally symmetrical about either axis. The ratio between the length 'l' and width 'w' determines the degree of eccentricity or elongation of the curve. In the special case of the super-ellipses in which the length 'l' and width 'w' are equal, the resulting substantially square or round curves, known as "super-circles", comprise four identical quadrants.

The exponent 'n' in the equation determines the circularity of the curve. For an exponent 'n' equal to 2, the curve forms a perfect circle or ellipse, depending on the values of 'w' and 'l'. As the exponent 'n' increases from 2 the curve becomes progressively more rectangular, until a perfect square or rectangle is produced when requires the exponent reaches an infinitely large value. For practical purposes, however, a substantially rectangular curve is produced by any exponent 'n' greater than about 5. As the exponent 'n' is reduced from 2 toward 1, the curve again becomes progressively more rectangular, but with the sides rotated 45 degrees (45°) to form a diamond-like shape. Thus exponents 'n' between two and one produce closed curves which substantially mirror the degree of rectangularity of the closed curves having exponents 'n' between 2 and infinity. Values of 'n' between one and zero produce concave curves similar to four-pointed stars, and will not be considered further herein.

The smoothly curving outer surface 102 of the adaptor ring 100 of the present invention comprises a horizontal cross-section in the shape of a super-ellipse. The super-ellipse defining the outer surface of the preferred embodiment has an exponent between about 3.5 and 1.7, and optimally of about 3.0. However adaptors having sufficiently rounded outer surfaces to be readily handled by robotic manipulators of substantially cylindrical objects are produced using super-ellipses having exponents between about 4.0 and 1.5.

The length and width of the outer surface of the adaptor ring can be the same, producing a super-circular adaptor ring. Preferably, however, the length of the adaptor ring 100 is slightly greater than the width thereof, in a ratio of about 35:32. This ratio provides an adaptor ring 100 well suited to use with a refuse container 10 which is slightly longer than it is wide.

It will be appreciated that, although specific embodiments of the invention have been described herein for purposes of illustration, various modifications may be made without departing from the spirit and scope of the invention. Accordingly, the scope of the invention is not limited except as by the following claims.

What is claimed is:

1. For use with a substantially rectangular container having planar exterior walls tapering inwardly toward a lower portion of said container and defining a substantially rectangular horizontal cross-section therethrough, a ring-like adaptor for adapting the container to be handled by a robotic manipulator of substantially cylindrical objects, said adaptor comprising:

(a) a smoothly curving outer surface having a horizontal cross-section substantially in the form of a super-ellipse;

(b) substantially planar inner mating surfaces for frictionally engaging and mating with the exterior walls of an upper portion of the container, said inner mating surfaces defining a substantially rectangular horizontal cross-section therethrough, such that the adaptor is removably mountable on the container by sliding said adaptor upwardly from the lower portion of the container until the inner mating surfaces of the adaptor are frictionally arrested by the exterior walls of the container to prevent further upward movement of the adaptor; and (c) locking means for positively securing the adaptor in position around the upper portion of the container to prevent downward movement of the adaptor toward the lower portion of the container both when the container is upright and when the container is inverted.

2. An adaptor as recited in claim 1, wherein the exponent of the super-ellipse of the outer surface of the adaptor is between about 4.0 and about 1.5.

3. An adaptor as recited in claim 1, wherein the container is a refuse container, and wherein the adaptor adapts the refuse container to be handled by a robotic manipulator for lifting, inverting and replacing substantially cylindrical or frustoconical refuse containers.

4. An adaptor as recited in claim 1, further comprising upper and lower circumferential lips extending outwardly from respective upper and lower portions of the outer surface of the adaptor.

5. An adaptor as recited in claim 1, wherein the container further includes a handle spaced outwardly from an exterior wall of the container, and wherein the locking means of the adaptor includes means for engaging the handle of the container.

6. An adaptor as recited in claim 1, wherein the container further includes a lift bar normally disposed horizontally and spaced outwardly from a portion of one of the exterior walls of the container, and wherein the locking means of the adaptor includes means for supporting the adaptor upon the lift bar of the container.

7. An adaptor as recited in claim 1, wherein the container further includes a downwardly extending lip spaced outwardly from an upper portion of one of the exterior walls of the container, and wherein the adaptor comprises a lip engaging element extending upwardly above the adaptor and being adapted to be received within a pocket between the lip and such exterior wall of the container.

8. An adaptor as recited in claim 1, wherein the adaptor is substantially hollow.

9. For use with a substantially rectangular container having planar exterior vertical walls tapering inwardly toward a lower portion of the container and defining a substantially rectangular horizontal cross-section therethrough, a horizontal handle spaced outwardly from an uppermost portion of a first exterior wall of the container, and a removable lift bar normally supported horizontally on and spaced outwardly from an opposite second exterior wall of the container, a ring-like adaptor for adapting the container to be handled by a robotic manipulator of substantially cylindrical or frustoconical objects, said adaptor comprising:

(a) a smoothly curving outer surface having a horizontal cross-section substantially in the form of a super-ellipse, said super-ellipse having an exponent between about 3.5 and about 1.7;

(b) substantially planar inner mating surfaces for respectively frictionally engaging and mating with the exterior walls of the container, said inner mating surfaces defining a substantially rectangular horizontal cross-section therethrough, such that the adaptor is removably mountable on the container by sliding said adaptor upwardly from the lower portion of the container until the inner mating surfaces of the adaptor are frictionally arrested by the exterior walls of the container to prevent further upward movement of the adaptor;

(c) a locking arm extending upwardly above an inner surface of the adaptor, said inner surface mating with the first exterior wall of the container, said locking arm having a channel therein for receiving the handle of the container to retain the adaptor in position relative to the first exterior wall of the container; and means for supporting the adaptor immediately above the lift bar of the container to retain the adaptor in position relative to the second exterior wall of the container.

10. An adaptor as recited in claim 9, wherein the exponent of the super-ellipse of the outer surface of the adaptor is about 3.0, and the ratio of the length of said super-ellipse to the width thereof is about 35:32.

11. An adaptor as recited in claim 9, wherein the container further includes a downwardly extending lip spaced outwardly from an uppermost portion of the second exterior wall of the container, and the adaptor further comprises a lip engaging element extending upwardly above the adaptor and adapted to be received within a pocket defined between the lip and the second exterior wall of the container.

12. An adaptor as recited in claim 9, further comprising upper and lower circumferential lips extending outwardly from respective upper and lower portions of the outer surface of the adaptor.

13. For use with a substantially rectangular refuse container having substantially planar front, rear and side exterior vertical walls tapering inwardly toward a lower portion of said container and defining a substantially rectangular horizontal cross-section therethrough, a horizontal handle spaced rearwardly from an uppermost portion of the rear wall of the container, and a removable lift bar normally supported horizontally on and spaced forwardly from a portion of the front wall of the container, a hollow ring-like adaptor for adapting the container to be handled by a robotic manipulator of substantially cylindrical or frusto-conical objects, said adaptor comprising:

(a) a smoothly curving outer surface having a horizontal cross-section substantially in the form of an super-ellipse, said super-ellipse having an exponent of about 3.0 and a ratio of length to width of about 35:32;

(b) upper and lower circumferential lips extending outwardly from respective upper and lower portions of said outer surface;

(c) substantially planar front, rear and side inner mating surfaces for respectively frictionally engaging and mating with the front, rear and side exterior walls of the container, said inner mating surfaces defining a substantially rectangular horizontal cross-section therethrough, such that the adaptor is removably mountable on the container by sliding said adaptor upwardly from the lower portion of the container until the inner mating surfaces of the adaptor are frictionally arrested by the exterior walls of the container to prevent further upward movement of the adaptor; and (d) a rear locking arm extending upwardly above the rear inner surface of the adaptor, said rear locking arm having a channel therein for receiving the handle of the container to prevent downward movement of a rear portion of the adaptor toward the lower portion of the container, wherein said adaptor is sized to be supported by the lift bar of the container to prevent downward movement of a front portion of the adaptor.

14. An adaptor as recited in claim 13, wherein the container further includes a downwardly extending front lip spaced outwardly from an uppermost portion of the front wall, and wherein the adaptor further comprises a front lip engaging element extending upwardly above the adaptor and sized to be received in a pocket defined between the front lip and the front wall of the container.

15. An adaptor as recited in claim 13, wherein the exterior walls of the container are contoured, and wherein the inner mating surfaces of the adaptor are contoured to mate with the contours of the exterior walls of the container.

* * * * *